United States Patent [19]

Williams et al.

[11] Patent Number: 4,593,464

[45] Date of Patent: Jun. 10, 1986

[54] METHOD OF MAKING A TRIAXIAL ELECTRICAL CONNECTOR

[75] Inventors: Robert L. Williams, Bainbridge; Christopher Marks, Guilford, both of N.Y.

[73] Assignee: Allied Corporation, Morristown, N.J.

[21] Appl. No.: 665,473

[22] Filed: Oct. 29, 1984

Related U.S. Application Data

[62] Division of Ser. No. 523,481, Aug. 15, 1983, Pat. No. 4,519,666.

[51] Int. Cl.[4] ..... H01R 43/02

[52] U.S. Cl. ..... 29/879; 228/136; 339/276 R

[58] Field of Search ..... 29/876, 877, 879, 881, 29/882, 883, 509, 522; 339/252 P, 252 R, 276 R; 228/136

[56] References Cited

U.S. PATENT DOCUMENTS

| | | | |
|---|---|---|---|
| 2,238,319 | 4/1941 | Goldfield . | |
| 2,461,268 | 2/1949 | Goldfield . | |
| 4,277,886 | 7/1981 | Bauer et al. | 228/136 X |
| 4,515,427 | 5/1985 | Smit | 339/276 R |

*Primary Examiner*—Howard N. Goldberg
*Assistant Examiner*—Carl J. Arbes
*Attorney, Agent, or Firm*—C. D. Lacina

[57] ABSTRACT

Conductive terminals (40) are plastically deformed whereby to connect electrically and mechanically to one or another of a pair of tubular electrical conductors (10,20) of a triaxial connector. Each terminal has an annular groove (41) therein received within a respective notch (13) in a lip extending from one of the respective tubular conductors (20, 30) and the terminal is struck to deform the walls of the groove around the lip. The other end of each terminal (40) is connected to the connector housing (1) by a plastic potting compound (50).

4 Claims, 5 Drawing Figures

FIG. 1
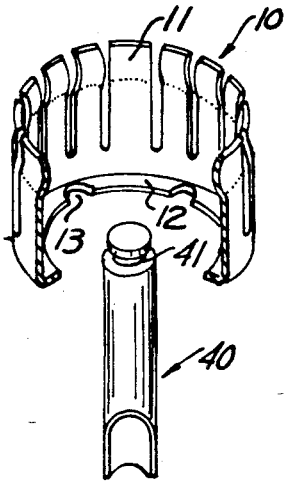
FIG. 2
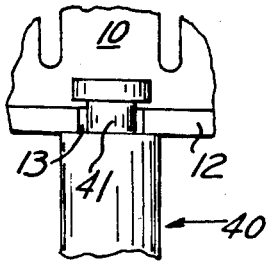
FIG. 3
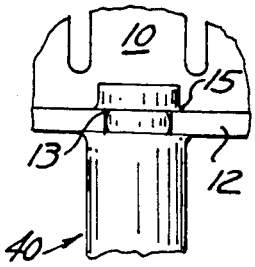
FIG. 4
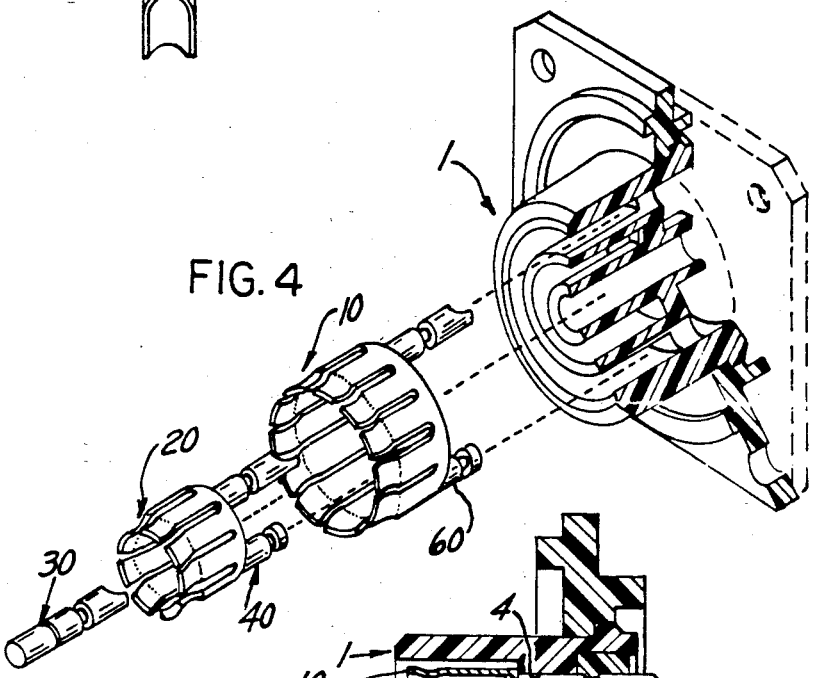
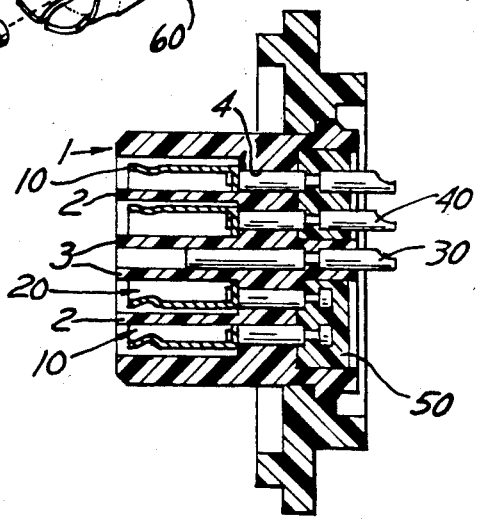
FIG. 5

METHOD OF MAKING A TRIAXIAL ELECTRICAL CONNECTOR

This application is a division of application Ser. No. 523,481, filed 8-15-83 now U.S. Pat. No. 4,519,666 issued May 28, 1985.

This invention relates to a triaxial electrical connector and method and apparatus for mounting the tubular contacts of the connector to the connector housing.

Triaxial electrical connectors generally include two tubular electrical conductors and a center conductor, all concentrically mounted and electrically isolated from each other within a housing. The tubular conductors each have a radially inwardly extending lip that includes one or more notches therein that receive a metal terminal. The forward end portion of each terminal was then deformed against the surface of the lip, while the other end of each terminal extended through a passage in the housing and was held in place by a potting compound poured into the housing. This mechanically connected the terminals and hence the conductors to the housing. However, such an arrangement often resulted in a loose connection between the conductors and terminals which resulted in an ureliable electrical connection.

DISCLOSURE OF THE INVENTION

This invention provides a method and apparatus for obtaining a good mechanical and electrical connection between the forward mating portion and the rear terminal portion of an electrical contact within a triaxial connector.

The invention is characterized by electrically conductive terminal having a forward end portion that includes an annular groove therein that is located in a notch in a radial lip of a tubular conductor. The end of each terminal is struck to deform the walls of the groove around the lip to mechanically connect the terminal to the lip. The other end of the terminal extends through a passage in the housing and is connected to the housing by a potting compound. Preferably, the terminal is presoldered so that when the connection between the terminal and conductor is heated the connection is soldered together.

One advantage of the invention is that it provides a reliable electrical connection between the terminal portion and mating portion of a contact for a triaxial connector.

Another advantage of the invention is that the presoldering of the terminal before connecting it to the conductor eliminates manual soldering and permits automated soldering by reflow of the solder after the connection is made.

DETAILED DESCRIPTION OF THE INVENTION

FIG. 1 illustrates the tubular mating portion and the rear terminal portion of a contact for a triaxial connector.

FIGS. 2 and 3 illustrate how the terminal portion is mechanically connected to the tubular mating portion of the contact.

FIG. 4 is an exploded view of a triaxial electrical connector.

FIG. 5 is a cutaway view of a triaxial electrical connector incorporating the principles of this invention.

Referring now to the drawings, FIG. 1 illustrates an electrical contact generally comprised of a gold plated copper alloy. The contact includes a tubular conductor 10 having a forward mating portion that includes a plurality of spring fingers 11 that are resiliently and radially deflectable. The tubular conductor 10 also includes a radially inwardly extending lip 12 having one or more notches 13 therein. A cylindrically shaped electrically conductive terminal 40 has an annular groove 41 that is adapted to engage the notch 13 of the tubular conductor 10.

FIG. 2 illustrates the groove 41 in the cylindrical conductor 40 located in a notch 13 in the lip 12 of the tubular member 10. As seen in FIG. 3, after locating the groove of the cylindrical conductor 40 in the notch, the cylindrical conductor 40 is mechanically connected to the lip 12 of the tubular member 10 by striking the cylindrical conductor 40 so that the upper and lower faces of the groove captivate the lip 12 of the tubular conductor 10. After this is accomplished, the tubular conductor 40 is soldered 15 to the lip 12 of the tubular conductor 10. Preferably, this is accomplished by applying solder to the end portion of the cylindrical conductor 40 before it is connected to the lip 12 of the tubular conductor 12. Thus, after the connection is made the connection can be heated to melt the solder and assure an excellent electrical connection.

FIG. 4 is an exploded view of a triaxial electrical connector incorporating the principles of the invention. The triaxial electrical connector includes an electrically nonconducting housing 1, first and second tubular conductors 10 and 20, a center conductor 30 and a plurality of cylindrical conductors 40 connected to respective tubular conductors. The nonconducting housing includes integral therewith, first second tubular insulators 2, 3 to isolate the tubular conductors 20, 30 and the center conductor 30 from each other.

FIG. 5 illustrates a cutaway view of a triaxial electrical connector. This view illustrates how the cylindrical conductors or terminals 40 are each connected to a respective tubular conductor 20 or 30 and the housing 1. The terminals 40 extend through passages 4 in the rear end of the housing 1 and into a void portion of the housing 1 which is filled with a potting compound 50 to mechanically connect the cylindrical conductors 40 to the housing 1. At least one terminal 40 attached to a respective tubular conductor 20 and 30 extends beyond the potting compound for connection to electrical wires (not shown) to provide appropriate electrical connections to the tubular conductors 20 and 30.

Having described the invention what is claimed is:

1. A method of electrically and mechanically connecting an electrically conductive terminal having an annular groove to a tubular electrical conductor including a radially extending lip having a notch therein comprising the steps:

placing the annular groove of the terminal into the notch of the tubular conductor so that upper and lower walls of the groove confront, respectively, the top and bottom surfaces of the lip adjacent to the notch;

plastically deforming the terminal locally of the groove and about the notch until the lip is captivated by the deformed walls of the groove thereby mechanically connecting the terminal to the lip of the conductor; and applying solder around the mechanical connection between said terminal and the lip of said tubular conductor.

2. The method as recited in claim 1 including the step of placing a coating of solder on the outer periphery of said terminal and locally of the groove before the step of placing the groove into the notch in the tubular conductor.

3. The method as recited in claim 1 including the steps of:

placing the annular grooves from each of a plurality of terminals into a respective notch formed in one or another of a pair of tubular conductors and plastically deforming each of the terminals;

placing the connected terminals and tubular conductors into a cylindrical connector housing: and applying a potting material to the rear end portions of each terminal in the rear portion of the housing.

4. The method as recited in claim 2 wherein the annular groove is in one end portion of the terminal and further including the steps of:

placing the connected terminal and tubular conductor into a cylindrical connector housing; and filling the rear portion of the connector housing with a dialectric potting material whereby to embed the other end of the terminal in the rear portion of the housing.

* * * * *